US011360407B2

(12) United States Patent
Schmidt

(10) Patent No.: US 11,360,407 B2
(45) Date of Patent: Jun. 14, 2022

(54) MULTI-PORTION CONSUMABLE COMPONENT IDENTIFIER

(71) Applicant: HEWLETT-PACKARD DEVELOPMENT COMPANY, L.P., Spring, TX (US)

(72) Inventor: Wayne J. Schmidt, Boise, ID (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/257,171

(22) PCT Filed: Nov. 1, 2018

(86) PCT No.: PCT/US2018/058629

§ 371 (c)(1),
(2) Date: Dec. 30, 2020

(87) PCT Pub. No.: WO2020/091779

PCT Pub. Date: May 7, 2020

(65) Prior Publication Data

US 2021/0181654 A1 Jun. 17, 2021

(51) Int. Cl.
*G03G 15/08* (2006.01)
*G03G 15/00* (2006.01)

(52) U.S. Cl.
CPC ..... *G03G 15/0867* (2013.01); *G03G 15/0863* (2013.01); *G03G 15/5058* (2013.01)

(58) Field of Classification Search
CPC ..... G03G 15/0867; G03G 15/0863; G03G 15/5058; G03G 2215/0695; G03G 2215/0697; G03G 21/1875; G03G 21/1892; G03G 21/1896
See application file for complete search history.

(56) References Cited

U.S. PATENT DOCUMENTS

| | | | | |
|---|---|---|---|---|
| 8,311,419 | B2 | 11/2012 | Jones | |
| 8,391,729 | B2 | 3/2013 | Kim et al. | |
| 8,508,770 | B2 | 8/2013 | Lee et al. | |
| 8,762,716 | B2 | 6/2014 | Eom et al. | |
| 9,336,471 | B2 | 5/2016 | Jeong et al. | |
| 9,594,897 | B2 | 3/2017 | Lee | |
| 9,973,658 | B2 | 5/2018 | Lee et al. | |
| 2002/0012541 | A1* | 1/2002 | Takemoto | G03G 21/1892 399/12 |
| 2011/0305465 | A1 | 12/2011 | Mimura | |
| 2012/0134687 | A1* | 5/2012 | Jones | G03G 15/0863 399/12 |
| 2017/0208059 | A1 | 7/2017 | Shin | |

FOREIGN PATENT DOCUMENTS

| | | | |
|---|---|---|---|
| CN | 104794389 | A | 7/2015 |
| WO | WO-2015030749 | A1 | 3/2015 |

* cited by examiner

*Primary Examiner* — Sandra Brase
(74) *Attorney, Agent, or Firm* — Trop Pruner & Hu, P.C.

(57) ABSTRACT

In one example in accordance with the present disclosure, a print device is described. The print device includes multiple consumable components. Each consumable component includes a portion of a hardware-based identifier. At least one sensor of the print device reads multiple portions of the hardware-based identifier. A controller of the print device combines the multiple portions of the hardware-based identifier and verifies the hardware-based identifier to determine an authenticity of the multiple consumable components.

20 Claims, 8 Drawing Sheets

MULTI-PORTION CONSUMABLE COMPONENT IDENTIFIER

BACKGROUND

Print devices are used to form markings on a print target. For example, a two-dimensional (2D) printer ejects ink/toner to form images/text on print media. In another example, a three-dimensional (3D) printer ejects fluid, such as a fusing agent, onto a bed of build material. To generate these markings, print devices include multiple components. These components may be replaceable over time. For instance, some components, referred to herein interchangeably as consumable print device components and consumable components, may have a shorter lifespan than the print device in which they are disposed.

BRIEF DESCRIPTION OF THE DRAWINGS

The accompanying drawings illustrate various examples of the principles described herein and are part of the specification. The illustrated examples are given merely for illustration, and do not limit the scope of the claims.

Figure 1:
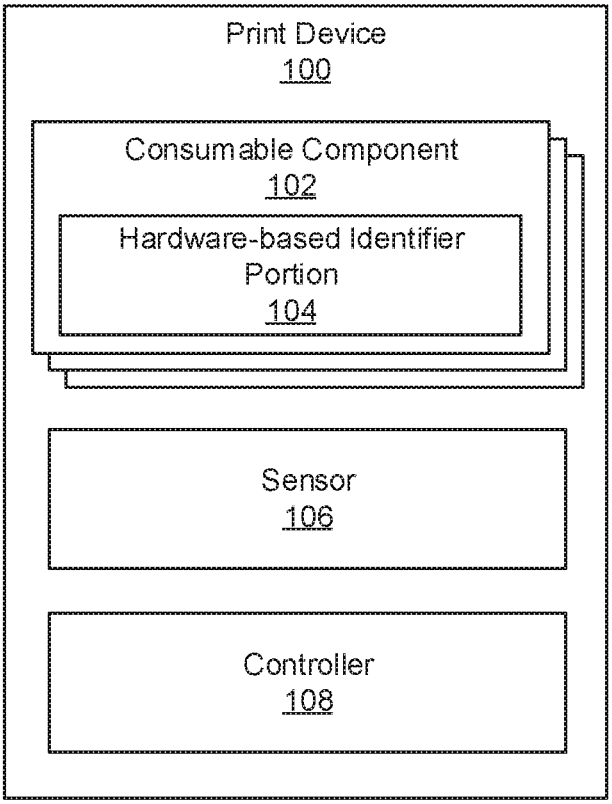
FIG. 1 is a block diagram of a print device to read a multi-portion consumable component identifier, according to an example of the principles described herein.

Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION

Print devices form markings, including images and text, on a print medium. To form such markings, print devices include various components that are replaceable. In a specific example, some print devices form markings on print media using electrophotography and/or by fusing print substances to print media. The act of forming markings on print media using an electrophotographic print device may 1) exhaust print substances (e.g., toner and carrier), 2) wear out components that contact print media and/or other print device components (e.g., an intermediate transfer belt, an organic photoconductor (OPC) drum, etc.), and 3) otherwise lead to replacement of components.

Replacement of components is not restricted to electrophotographic print devices. For example, print devices that use thermal resistors or piezoelectric elements to eject print substance from nozzles towards print media also include replaceable components. Examples of replaceable components in these types of print devices include, but are not limited to, printheads, print cartridges, and print substance reservoirs. By way of further non-limiting example, three-dimensional (3D) print devices may also include components that are to be replaced during the life of the print device.

As used herein, replaceable device components, such as the example print device components discussed in the foregoing, are referred to as "consumable components," "consumable print device components," or "long life consumables." While, the present application describes several example consumable components, such as an OPC drum, a developer unit, and an intermediate transfer belt, other examples of consumable components may be implemented in accordance with the principles discussed herein.

While using replaceable components may extend the life of the print device as the life of the print device is not limited by the life of a particular component, there may be a desire to ensure a minimum quality of a consumable component. For example, a replacement consumable component of a quality that is lower than that of an original consumable component may yield prints of lower quality than would be produced had original consumable components been used. The print device may also be incompatible with certain replacement consumable components resulting in improper operation of the device and potential damage of the print device.

Accordingly, the present specification describes a print device, method, and consumable component that allows for the authentication of consumable components used in a print device, thus ensuring compatibility and a high quality of output. As used herein, authentication refers to mechanisms and/or processes to determine a source and/or identity of a consumable component and to confirm that the determined source and/or identity corresponds to authorized sources and/or identities. That is, a consumable component that is not authenticated may be from a source that is not authorized whereas a consumable component that is authenticated may be from an authorized source.

The present specification also describes using an identifier to enable tracking of consumable components. Furthermore, tracked attributes and characteristics may be useful to provide altered device operation (e.g., selecting print characteristics based on material attributes). For example, the identifier may be used to instruct the print device to alter certain parameters to optimize performance.

Some forms of consumable component identification and/or authentication include the use of a computer-readable medium coupled to a consumable component. In these examples, the computer-readable medium may be communicably coupled to an integrated circuit (IC) on the consumable component. The computer-readable medium may store signals or states to enable authentication of the consumable component. However, in spite of security precautions including encryption of the data stored on the computer-readable medium, manufacturers of unauthorized consumable components may be able to copy the data stored in the computer-readable medium and/or the IC in order to forge a source and/or an identity and trick print devices into authenticating consumable components of low quality. As a result, users may unknowingly install consumable components that may cause damage—sometimes permanent—to the print device.

Accordingly, the present specification describes the use of a hardware-based identifier. Hardware-based identifiers may include alphanumeric characters, shapes, colors, or combinations thereof, arranged on a consumable component. Hardware-based identifiers are distinguished from identifiers stored as signals and/or states in a computer-readable medium of a consumable component. For example, a serial number or bar code printed on a consumable component is a hardware-based component, while a serial number encoded in a computer-readable medium of an IC connected to a consumable component is not.

In one example, the hardware-based identifier may not be readily apparent to, for example, those seeking to sell low quality consumable components. That is, the hardware-based identifier may be human-indiscernible. As used herein, the term "human-indiscernible" refers to identifiers that are imperceptible to humans without the aid of some form of viewing mechanism or apparatus. For example, possible human-indiscernible identifiers may include 1) identifiers that are invisible in the visible light spectrums (e.g., approximately 400 nm to approximately 700 nm), 2) identifiers that are obscured under some material, and/or 3) identifiers that are expressed as a pattern that may not be readily perceived by a user (e.g., a QR code, bar code, or other pattern of colors and/or shapes). As the use of such physical hardware-based identifiers is difficult to hack, their replication and counterfeiting is difficult, thus providing an additional measure of security to the system.

As an additional measure of security, the present specification describes a system wherein the hardware-based identifier is in an encoded and distributed format on various consumable components. For example, one portion may be disposed on a first consumable component such as an organic photoconductor drum, a second portion may be disposed on a developer roller of a developer unit, and a third portion may be disposed on an intermediate transfer belt. The different portions are read from each consumable component, or transferred copies of the portions are read from a single consumable component, and then combined together by the print device. The print device could then determine, from the combined hardware-based identifier, whether the group of consumable components is authenticated for use with the print device. Accordingly, the present specification describes an authentication system with enhanced security as it relates to deciphering the different portions of the identifier in aggregate. That is, rather than maliciously replicating a single consumable component, a nefarious party would have to replicate all the components, which is significantly more difficult. Put yet another way, a single portion of a hardware-based identifier would not only have to be authenticated by itself, but authenticated when combined with other portions of the hardware-based identifier.

Specifically, the present specification describes a print device. The print device includes multiple consumable components. Each consumable component includes a portion of a hardware-based identifier. At least one sensor of the print device reads multiple portions of the hardware-based identifier. A controller of the print device 1) combines the multiple portions of the hardware-based identifier and 2) verifies the hardware-based identifier to determine an authenticity of the multiple consumable components.

The present specification also describes a method. According to the method, a first portion of a distributed hardware-based identifier for a first consumable is read. Similarly, a second portion of the distributed hardware-based identifier for a second consumable product is read. An authenticity of a combination of the first consumable component and the second consumable component is determined based on a combination of the first portion and the second portion.

The present specification also describes a consumable component. The consumable component includes a surface and a portion of a human-indiscernible hardware-based identifier. The portion of the human-indiscernible hardware-based identifier is to be combined with other portions of the human-indiscernible hardware-based identifiers on other consumable components for verification of a group of consumable components.

In summary, using such a multi-portion hardware-based consumable component identifier 1) provides control over which consumable components may be used in a print device, 2) prevents against potential quality defects and component damage based on improper consumable component use, and 3) enhances security of the system by distributing the hardware-based identifier over multiple consumable components.

As used in the present specification and in the appended claims, the term "portion" refers to a portion of an identifier formed on a particular consumable component, or a copy of that portion as it has been transferred to another consumable component.

Turning now to the figures, FIG. 1 is a block diagram of a print device (100) to read a multi-portion consumable component identifier, according to an example of the principles described herein.

The print device (100) may be any device that deposits a print material on a surface. For example, a 2D print device (100) ejects a print compound such as toner onto paper media. In another example, a 3D print device (100) ejects a fusing agent onto a bed of a build material. As a print device (100) operates, certain components of the print device (100) may wear down and therefore may have a lifespan that is shorter than the print device (100). Such components, referred to as consumable components (102) may be replaced such that the life of the print device (100) is not limited by the shorter lifespan of the consumable components (102).

The consumable components (102) may be of varying types. For example, the consumable component (102) may be an intermediate transfer belt (ITB) that transfers image from a first transfer to the print media as a second transfer. An organic photoconductor (OPC) is another example of a consumable component (102). The OPC drum electrostatically attracts the printing compound to its surface in a particular pattern thereby creating the image, and deposits the printing compound, in that pattern, on the ITB. Yet another example of a consumable component (102) is the developer unit, and more particularly the developer roller within the developer unit. The developer unit of the print device (100) retains the printing compound and transfers it to the OPC drum in a process referred to as development. While specific reference is made to particular consumable components (102) on a particular type of print device, the identifiers described herein may be used in a number of example consumable components of a number of types of print devices, of which the present description presents but a few non-limiting examples.

As described above, the print device (100) may include multiple of these consumable components (102). Each consumable component (102) may include a portion (104) of a hardware-based identifier. A hardware-based identifier may take many forms. For example, the hardware-based identifier may be a serial number. Each portion (104) of the hardware-based identifier may include an incomplete part of the hardware-based identifier. When the portions (104) are combined, the information associated with the identifier be processed. For example, an identifier may include authentication information for the various consumable components (102), however, until all portions (104) are combined, the authentication information is undecipherable.

In some examples, each portion (104) may be included on a different type of consumable component (102). For example, one portion (104) may be on an OPC drum, another portion (104) on a developer roller, and yet another portion (104) on an ITB.

In another example, each portion (104) may be included on the same type of component (104). For example, a laser printer may have four developer rollers and four OPC drums. In this example, each may have a unique portion (104). In this example, portions (104) disposed on similar consumable types may be combined, i.e., the portions (104) on the OPC drums may all be combined, or portions (104) across consumables types may be combined, i.e., portions (104) on the OPC drums and on the developers may be combined.

The hardware-based identifier may take many forms. For example, as noted above it may be a string of alphanumeric characters with each portion (104) forming a part of the string. As another example, the hardware-based identifier may be a barcode, series of patterned markings, or a quick response code. When the different portions (104) are combined, either sequentially or in an overlapping fashion, the complete identifier is formed and processed. As described above, the hardware-based identifier may be used to confirm a source and identity of the consumable components (102).

The hardware-based identifier may be used for other purposes as well. For example, the identifier may instruct the print device (100) to alter certain parameters to optimize performance. For example, a particular consumable component (102) may have a different tolerance range for voltage bias sensitivity. In this example, the portion (104) of the identifier on that consumable component (102) could be used to instruct the print device (100) to increase an electrophotographic parameter to compensate.

While specific reference is made to a particular format of a portion (104) of the hardware-based identifier for a particular consumable component (102), such identifiers may take the form of combinations of lines, shapes, and/or colors such as bar codes and the like, without limitation.

As described above, the portions (104) of the hardware-based identifiers may be latent images, and therefore not visible. For example, a portion (104) of a hardware-based identifier may be etched into an external surface of the print cartridge and/or printhead and covered with a material. In another example, the portion (104) of the hardware-based identifier may be printed with a substance that is visible in limited light spectrums. In yet another example, the portion (104) of the hardware-based identifier may be embodied as a pattern that is not identifiable to humans without the use of a viewing apparatus. In one specific example, the portion of the hardware-based identifier (104) may be arranged on a surface of a consumable component (102) and covered with a material that is opaque in visible light, but that may allow light of certain spectrums, such as infrared (IR) spectrums (e.g., approximately 700 nm to approximately 1 mm) to traverse. In other examples, the portions (104) may be visible, but not discernible, for example as a pattern of colors, lines, and/or shapes.

In some examples, different portions (104) may be either visible, latent, or not discernible. For example, a portion (104) disposed on a developer roller may be visible while a portion (104) disposed on an OPC drum may be latent.

As described above, the portion (104) on one consumable component (102) by itself is not complete. That is, a deciphering of the portion (104) on a single consumable component (102) is not authenticatable until it is combined with portions (104) of the identifier located on other consumable components (102).

The print device (100) also includes at least one sensor (106) to read multiple portions (104), or copies thereof, of the hardware-based identifier. The sensor (106) may be capable of sensing electromagnetic radiation, such as within ultraviolet, visible, or infrared spectrums, by way of example. Example sensors (106) may include optical receivers and optical transceivers.

In one example, a single sensor (106) may be arranged with respect to one consumable component (102) to enable identifying and reading (e.g., determining) the combined hardware identifier. For example, the sensor (106) may be positioned near an ITB such that a portion (104) corresponding to the OPC drum and a portion (104) corresponding to the developer roller, which portions (104) are copied to the ITB, can be read from the ITB. In this example, a single sensor (106) disposed near one of the consumable components (102) reads each of the sections of the hardware-based identifier (104).

In another example, multiple sensors (106) disposed near different consumable components (102) read different portions (104). For example, a first sensor (106) disposed near the OPC drum may read a portion (104) of the hardware-based identifier corresponding to the OPC drum and may also read a portion (104) of the hardware-based identifier corresponding to the developer unit, which developer unit portion (104) may have been transferred to the OPC drum. In this example, a second sensor (106) may be disposed near the ITB to read the portion (104) of the hardware-based identifier corresponding to the ITB.

The print device (100) also includes a controller (108). The controller (108) combines the different portions (104) of the hardware identifier and verifies the combined hardware-based identifier to determine an authenticity of the multiple consumable components (102). That is, the portions (104) disposed on each of the consumable components (102) are read by a sensor (106) and are then passed to the controller (108) to be deciphered. If the combined hardware-identifier is approved by the controller (108), the controller (108) determines that the group of consumable components (102) are verified for use in the print device (100). By comparison, if the combined hardware-identifier is not approved by the controller (108), for example by not matching to any of a known set of identifiers, the controller (108) may perform certain operations. For example, the controller (108) may notify a user and/or prevent use of the consumable components (102) in the print device (100). In another example, the controller (108) may allow use of the consumable component (102), but may reduce its range or capability such that the print device (100) is protected from any damage resulting from its use.

Figure 2:
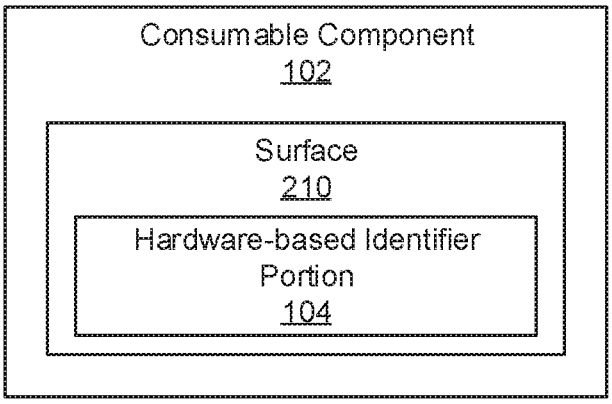
FIG. 2 is a block diagram of a consumable component with a portion of a multi-portion consumable component identifier, according to an example of the principles described herein.

FIG. 2 is a block diagram of a consumable component (102) with a portion (104) of a multi-portion consumable component identifier, according to an example of the principles described herein. The consumable component (102) includes a surface (210) on which the portion (104) is disposed. As described above, the portion (104) is combined with other portions (104), or copies thereof, on other consumable components (102) for verification of the group of consumable components (102).

As described above, the consumable component (102) may be of varying types, and the manner in which the portion (104) of the hardware-based identifier is disposed thereon may differ based on the type of consumable component (102). For example, the consumable component (102) may be an OPC drum. In this example, the surface (210) may be substrate disposed over the OPC drum. In this example, the substrate is electrically conductive and the surface of the OPC drum is both electrically conductive and photo-sensitive. In this example, the substrate is etched and by exposing the photosensitive surface of the OPC drum, a latent image is exposed, and the identifier is transferred to the ITB. In some examples, the surface (210) may or may not be covered with other layers to hide the portion (104) from the human eye.

In another example, the consumable component (102) is a developer roller of the developer unit. In this example, the surface (210) of the developer roller may include an embossed portion (104) such that as the developer roller collects print compound, a copy of that portion (104) is formed on the OPC drum in the pattern of the portion (104) at the nip between the developer roller and the OPC drum.

In yet another example, the consumable component (102) is an intermediate transfer belt (ITB). In this example, the portion (104) may be latent or visual image on the ITB that will be later detected by the sensor (FIG. 1, 106). For example, a strategic application of toner through an electrophotographic process could be used to expose the latent image.

Figure 3:
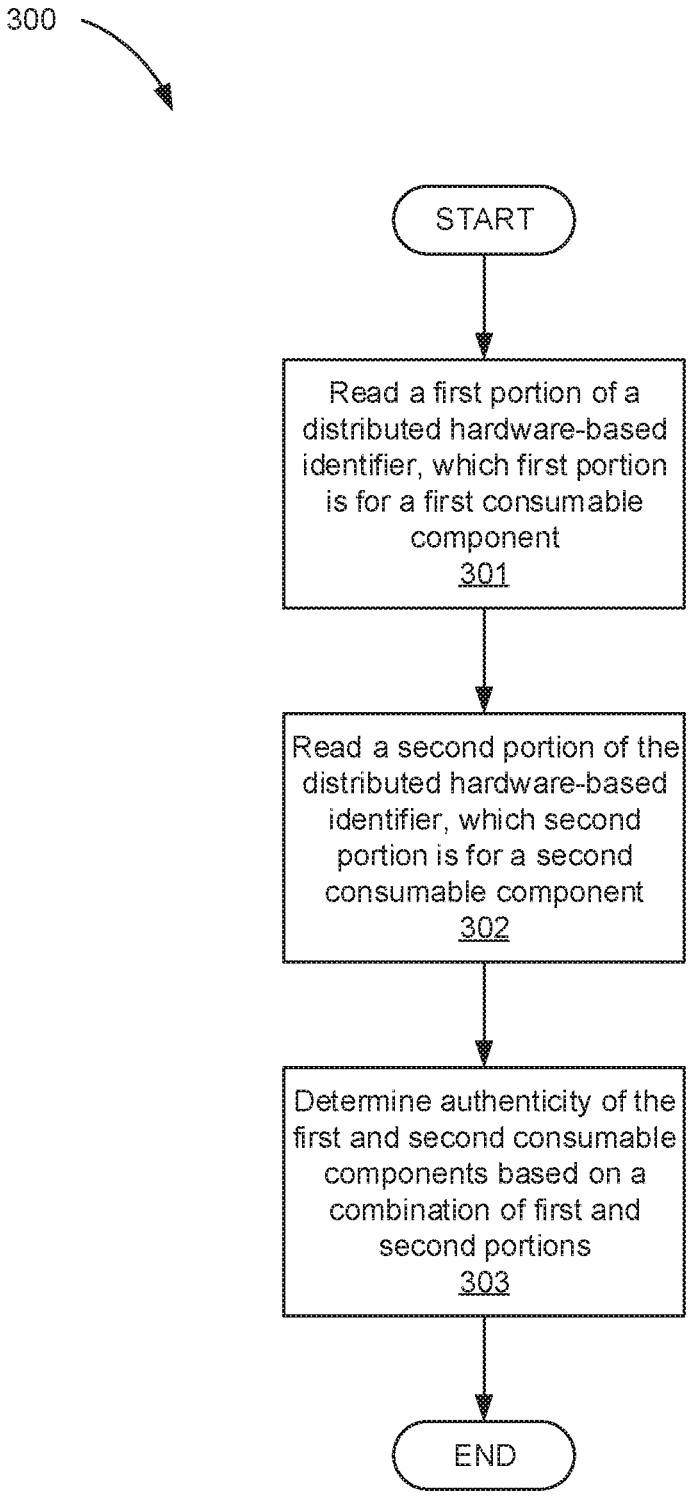
FIG. 3 is a flow chart of a method for reading a multi-portion consumable component identifier, according to an example of the principles described herein.

FIG. 3 is a flow chart of a method (300) for reading a multi-portion (FIG. 1, 104) consumable component (FIG. 1, 102) identifier, according to an example of the principles described herein. As noted above, reading the multi-portion (FIG. 1, 104) consumable component (FIG. 1, 102) identifier includes detecting different portions (FIG. 1, 104) of the hardware-based identifier as they are arranged on different consumable components (FIG. 1, 102) of a print device (FIG. 1, 100). This may be accomplished by one sensor (FIG. 1, 106) disposed near one consumable component (FIG. 1, 102) where visual copies of the different portions (FIG. 1, 104) are transferred to that one consumable component (FIG. 1, 102) or by multiple sensors (FIG. 1, 106) each disposed near a different consumable component (FIG. 1, 102). Signals representative of the detected portions (FIG. 1, 104) may then be transmitted to a controller (FIG. 1, 108) for combination and verification. As described above, each portion (FIG. 1, 104) in isolation does not facilitate authentication of the corresponding component (FIG. 1, 102) or group of components (FIG. 1, 102). However, when combined with other portions (FIG. 1, 104), the combined hardware-based identifier can be used, for example via comparison with known approved identifiers, to authenticate the consumable components (FIG. 1, 102) disposed within a print device (FIG. 1, 100).

According to the method (300), a first portion (FIG. 1, 104) of a distributed hardware-based identifier is read (block 301) and a second portion (FIG. 1, 104) of the distributed hardware-based identifier is read (block 302). The first portion (FIG. 1, 104) corresponds to a first consumable component (FIG. 1, 102) and the second portion (FIG. 1, 104) corresponds to a second consumable component (FIG. 1, 102), which may or may not be of the same type. In some cases, the multiple portions (FIG. 1, 104) may be read (block 301, 302) from the consumable component (FIG. 1, 102) on which they are disposed. For example, a first portion (FIG. 1, 104) may be arranged on an OPC drum and a second portion (FIG. 1, 104) may be arranged on an ITB. In this example, detection may include using a first sensor (FIG. 1, 106) arranged in proximity to the OPC drum to read the first portion (FIG. 1, 104). In one specific example, this first sensor (FIG. 1, 106) may be able to detect a latent image representing the first portion (FIG. 1, 104) on the surface of the OPC drum. A second sensor (FIG. 1, 106) in proximity to the ITB may read the second portion (FIG. 2, 104).

In another example, a single sensor (FIG. 1, 106) disposed near one of the consumable components (FIG. 1, 102) may read all of the portions (FIG. 1, 104). For example, a sensor (FIG. 1, 106) may be arranged in proximity to the ITB. In this example, copies of the portions (FIG. 1, 104) disposed on other consumable components (FIG. 1, 102) may be transferred to the surface (FIG. 2, 210) of the ITB either as latent images, as visual images, or combinations thereof. The sensor (FIG. 1, 106) near the ITB detects these copied portions (FIG. 1, 104).

As has been described, detecting the hardware-based identifier may include sensing a latent image thereof, sensing the human-indiscernible hardware-based identifier directly (e.g., such as for identifiers printed in a material that is responsive to non-visible electromagnetic radiation, such as infrared electromagnetic radiation), sensing reflections of human-indiscernible hardware-based identifiers and also reflections of latent images thereof, by way of non-limiting example.

In one specific example, at least one of the first portion (FIG. 1, 104) and the second portion (FIG. 1, 104) are read via the transmission of electromagnetic radiation towards the consumable component (FIG. 1, 102) and receiving reflected electromagnetic radiation. For example, the sensor (FIG. 1, 106) may transmit electromagnetic radiation towards a region of a consumable component (FIG. 1, 102) in which the portion (FIG. 1, 104) of the hardware-based identifier may be expected to be found. For example, as described below, there may be regions on a consumable component (FIG. 1, 102) in which the portion (FIG. 1, 104) may be found. As a specific example, the portions (FIG. 1, 104) may be arranged on peripheral regions of consumable components (FIG. 1, 102) so as to avoid interfering with marking a print medium.

In any case, the sensor (FIG. 1, 106) may transmit electromagnetic radiation to detect a latent hardware-based identifier portion (FIG. 1, 104). Reflected electromagnetic radiation is then received by the sensor (FIG. 1, 106). That is, the sensor (FIG. 1, 106) may include an optical transceiver, and may thus be capable of receiving the reflected electromagnetic radiation, which may be indicative of a latent hardware-based identifier (FIG. 1, 104). The received electromagnetic radiation may enable generation of signals, such as binary digital signals, representing the hardware-based identifier portion (FIG. 1, 104).

An authenticity of the combination of the consumable components (FIG. 1, 102) is then determined (block 303). That is, signals representative of the various portions (FIG. 1, 104) of the hardware-based identifier may be transmitted from the sensor(s) (FIG. 1, 106) to the controller (FIG. 1, 108). As described above, a sensor (FIG. 1, 106) may encode an image of the portions (FIG. 1, 104) of the hardware-based identifier in binary digital signals, by way of illustration. These signals may be transmitted from the sensor (FIG. 1, 106) to the controller (FIG. 1, 108).

The controller (FIG. 1, 108) may then combine the different portions (FIG. 1, 104) to determine (block 303) the authenticity of the group of consumable components (FIG. 1, 102). For example, the controller (FIG. 1, 108) may compare the combined portions (FIG. 1, 104) to a database of known or expected identifiers. If the combined portions (FIG. 1, 104) match any of the known or expected identifiers, the controller (FIG. 1, 108) may determine that the group of consumable components (FIG. 1, 102) are authentic, authorized, and/or verified.

In addition to authenticating the group of consumable components (FIG. 1, 102), the controller (FIG. 1, 108) may take additional action. For example, the controller (FIG. 1, 108) may alter an operation of a print device (FIG. 1, 100) based on the received signals. This may include providing alerts to users, for example in the form of user interface prompts on a display of the print device (FIG. 1, 100). Altering the operation of the print device (FIG. 1, 100) may also include placing the print device (FIG. 1, 100) in a mode of operation that will increase a likelihood of protecting the print device (FIG. 1, 100) from damage due to a consumable component (FIG. 1, 102) of an unknown source and/or quality.

As a specific example, if the signals indicate that the consumable components (FIG. 1, 102) are not authentic and/or cannot be otherwise authenticated, the controller (FIG. 1, 108) may provide a notification to a user that use of such a consumable component (FIG. 1, 102) may cause damage to the print device (FIG. 1, 100) or that the print device (FIG. 1, 100) may function in undesirable ways. While specific reference is made to particular alterations of the operation of the print device (FIG. 1, 100), other alterations may be implemented in accordance with the principles described herein.

Moreover, while the present specification describes the multi-portion hardware identifier being used to authenticate the group of consumable components (FIG. 1, 102), the hardware identifier may be used for other purposes. For example, the hardware identifier may allow the print device (FIG. 1, 102) to determine whether any of the particular consumable components (FIG. 1, 102) are subject to a recall. In this example, the controller (FIG. 1, 108) may trigger a relevant notification to the user, service representative, and/or manufacturer. Still further, as described above, the identifier may instruct the print device (FIG. 1, 100) to alter certain parameters to optimize performance.

Figure 5:
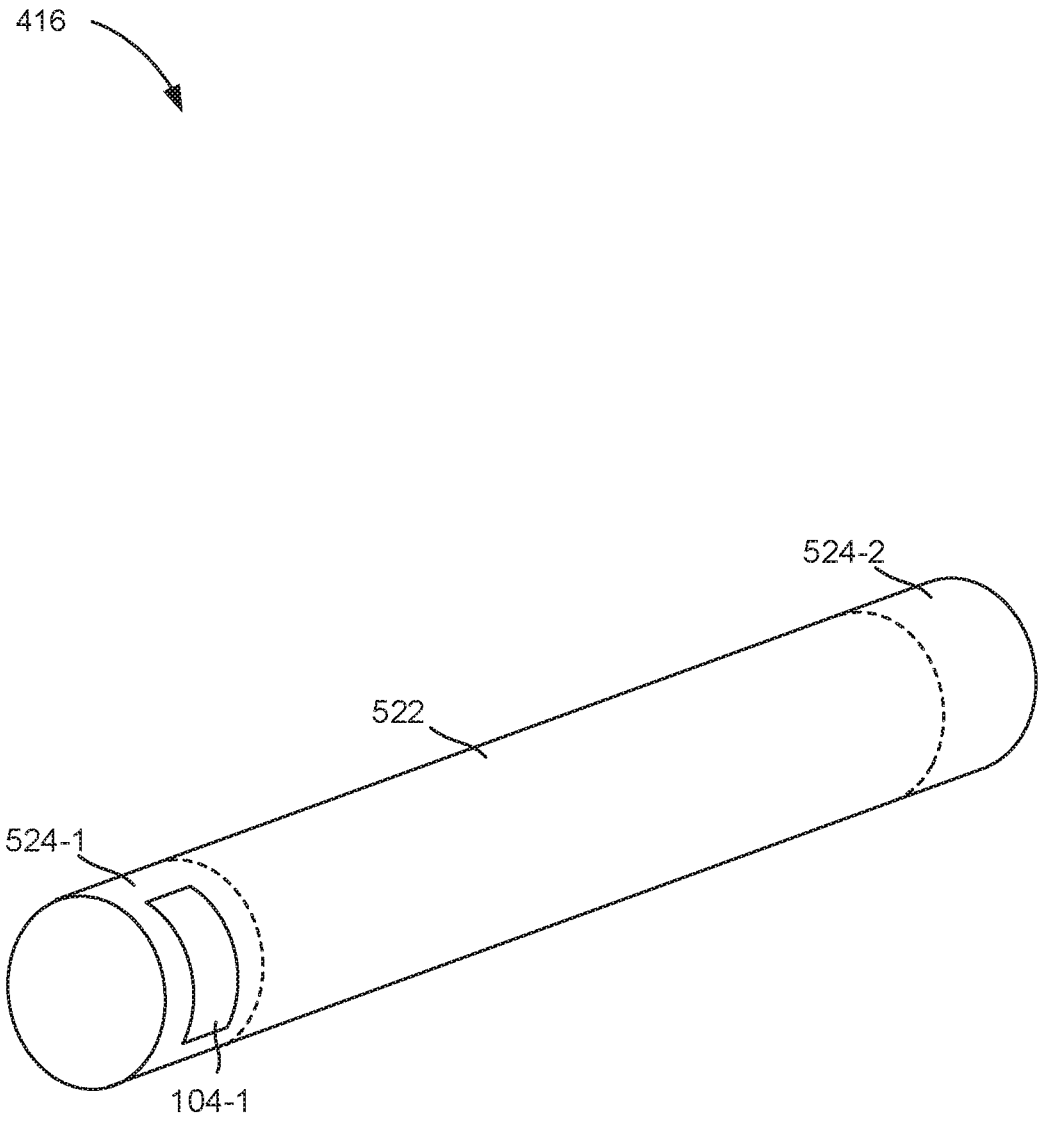
FIG. 5 is a perspective view of a developer roller of a developer unit with a portion of a multi-portion consumable component identifier disposed thereon, according to an example of the principles described herein.
Figure 6:
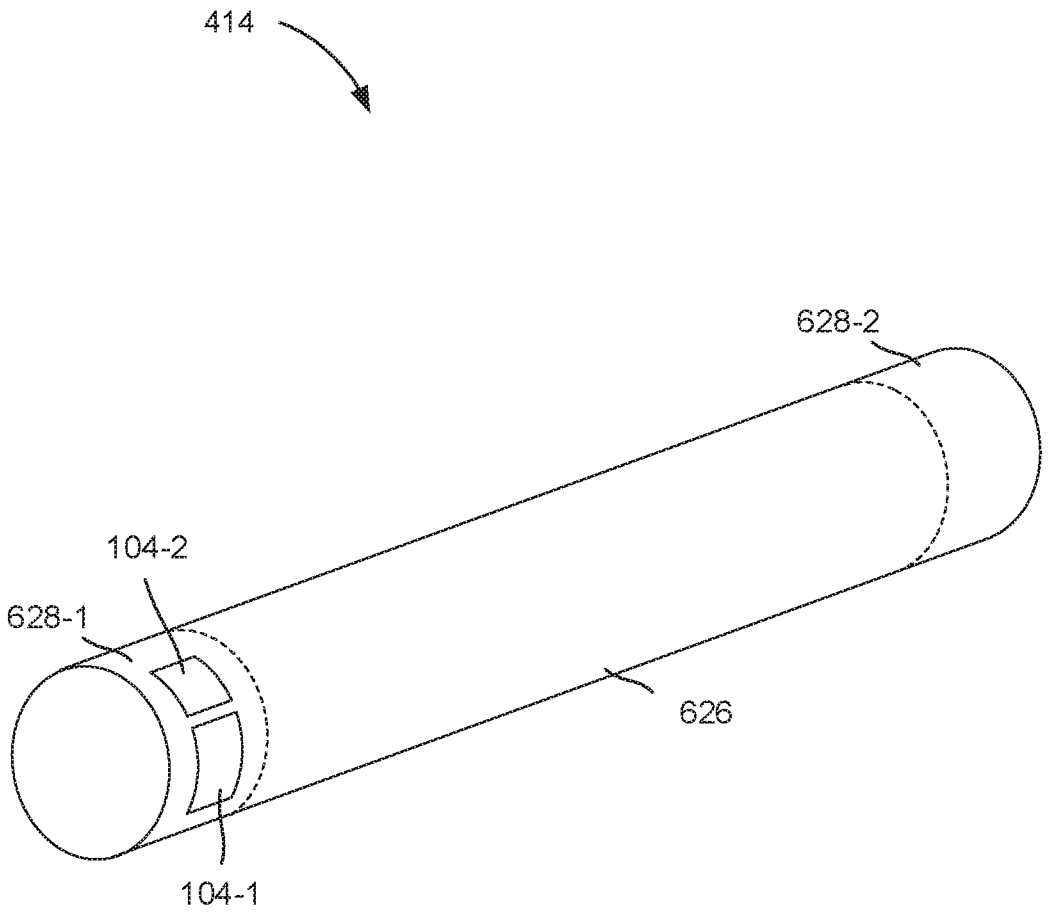
FIG. 6 is a perspective view of an organic photoconductor (OPC) drum with a portion of a multi-portion consumable component identifier disposed thereon, according to an example of the principles described herein.

Other such information may also be stored in, or associated with, the multi-portion hardware identifier. While FIG. 3 specifically describes the combination of a first portion (FIG. 1, 104) and a second portion (FIG. 1, 104) of the hardware-based identifier, the identifier may be divided into any number of portions (FIG. 1, 104). For example, as depicted in FIGS. 4-6, the identifier may be separated into three portions (FIG. 1, 104).

Figure 4:
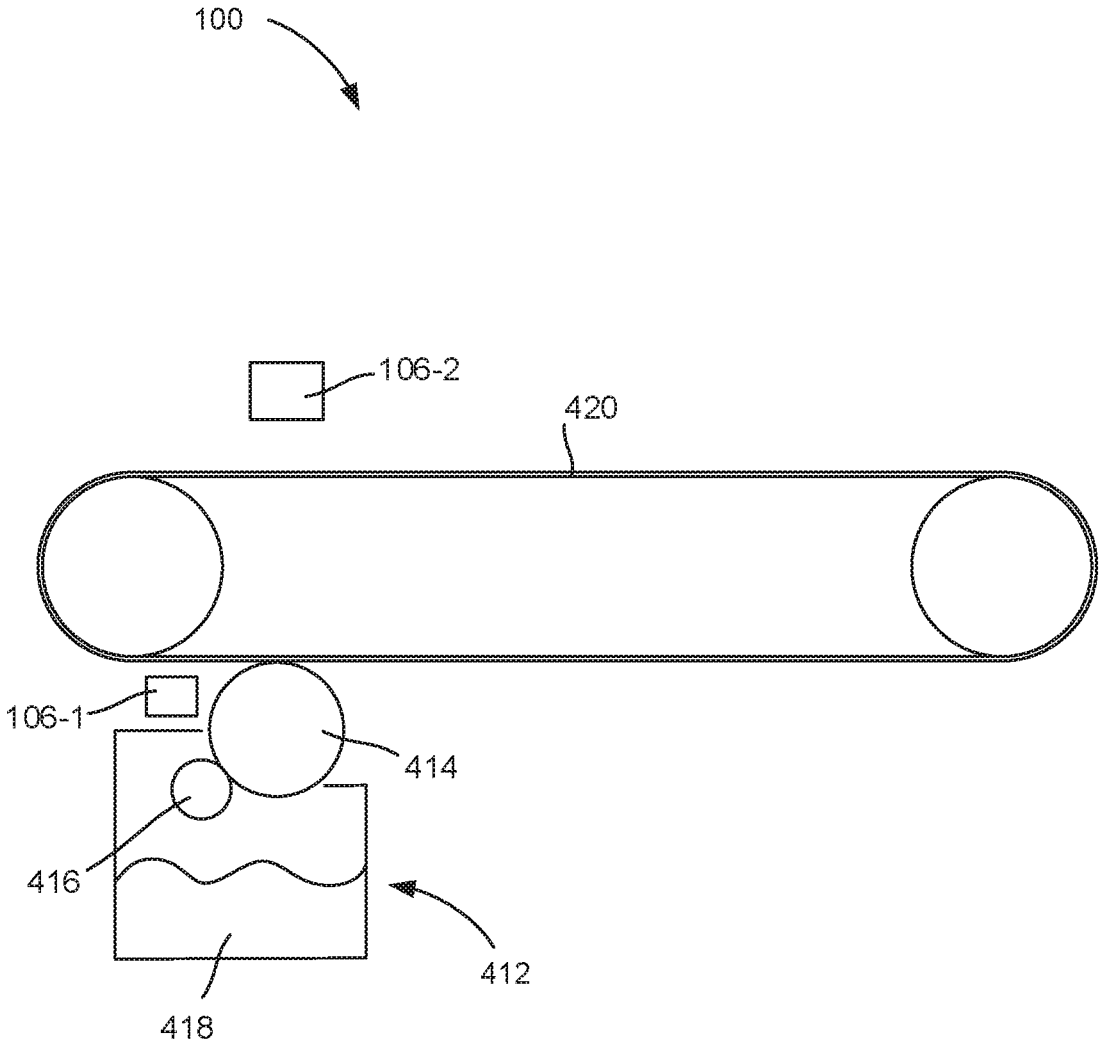
FIG. 4 is a side view of a print device for reading a multi-portion consumable component identifier, according to an example of the principles described herein.

FIG. 4 is a side view of a print device (100) for reading a multi-portion (FIG. 1, 104) consumable component (FIG. 102) identifier, according to an example of the principles described herein. To facilitate printing, the print device (100) includes multiple components. Specifically, the print device (100) may have a printing system. The printing system may include various components to facilitate the printing of images onto a print media. Specifically, the printing system may include an organic photoconductor (OPC) drum (414). The printing system may also include a developer roller (416) to enable transfer of a print compound (418) such as toner to the OPC drum (414). For example, due to an electrical charge on the surface of OPC drum (414), print compound (418) may be attracted to the OPC drum (414). The print compound (418) may form an image, either latent or visible, on the OPC drum (414). This image may correspond to a portion (FIG. 1, 104) of a hardware-based identifier. That is, the print compound (418) may be attracted to a surface of OPC drum (414) to form a copy of the portion (FIG. 1, 104) of the hardware-based identifier.

Another portion (FIG. 1, 104) of the hardware-based identifier may be associated with the developer roller (416). In this case, the developer roller (416) may have an embossed surface such that as the print compound (418) is deposited thereon, a copy of the embossed portion (FIG. 1, 104) is formed on the developer roller (416). This copy is transferred to the OPC drum (414) at the nip formed there between.

As described above, the print device (100) includes at least one sensor (106). In one example, a first sensor (106-1) may be arranged in relation to OPC drum (414) in order to read portions (FIG. 1, 104) that correspond to the OPC drum (414) and/or the developer roller (416).

Yet another portion (FIG. 1, 104) of the hardware-based identifier may be associated with the intermediate transfer belt (420). In this case, the intermediate transfer belt (420), like the OPC drum (414), may have a latent or visual portion (FIG. 1, 104) formed thereon. In one example, a second sensor (106-2) may be arranged in relation to ITB (420) in order to read portions (FIG. 1, 104) that correspond to ITB (420). In another example, the second sensor (106-2) may be the only sensor and may read portions (FIG. 1, 104), or copies thereof, of the hardware-based identifier that pertain to the ITB (420), the OPC drum (414), and the developer roller (416), the latter two having been transferred to the ITB (420). That is, in some examples the different portions (FIG. 1, 104) of the identifier may be juxtaposed. That is, the printing system may be under the control of a controller that copies the different portions (FIG. 1, 104) on one of the consumable components (FIG. 1, 102), specifically the ITB (420). In this example, a single sensor (106-2) reads the multiple juxtaposed portions (FIG. 1, 104) of the hardware-based identifier form the single consumable component (FIG. 1, 102), i.e., the ITB (420).

Put another way, the print device (100) includes 1) a developer unit (412) that has a first unique portion (FIG. 1, 104) of the hardware-based identifier; 2) an OPC drum (414) that includes a second unique portion (FIG. 1, 104) of the hardware-based identifier; and 3) an ITB (420) that include a third unique portion (FIG. 1, 104) of the hardware-based identifier. The ITB (420) receives copies of the portions (FIG. 1, 104) from the OPC drum (414) and the developer roller (416) such that they are all read from the surface of the ITB (420).

While FIG. 4 depicts one developing unit (412), the print device (100) may include multiple developing units (412). Accordingly, the ITB (420) may receive portions (FIG. 1, 104) from each developing unit (412). For example, in one implementation a print device (100) includes separate developing units (412) for different colors (CMYK), each paired or mated with a different OPC drum (414). For instance, a cyan developing unit (412) may include a first OPC drum (414), a magenta developing unit (412) may include a second OPC drum (414), a yellow developing unit (412) may include a third OPC drum (414), and a black developing unit (412) may include a fourth OPC drum (414). Each OPC drum (414) may have a different portion (FIG. 1, 104) of the hardware-based identifier that may be transferred to the ITB (420). In this example, the second sensor (106-2) may detect the portions (FIG. 1, 104).

While FIG. 4 presents an example of a print device (100) that includes an OPC drum (414), a developing unit (412) and an intermediate transfer belt (420), the multi-portion (FIG. 1, 104) identifiers described herein may be used on other print devices. For example, print devices that use thermal resistors or piezoelectric elements to eject print substance from nozzles towards print media also include replaceable components. In these examples, the different components, i.e., printheads, print cartridges, and print substance reservoirs, may also have portions (FIG. 1, 104) of a hardware-based identifier that are used to authenticate the combination of replaceable components.

FIG. 5 is a perspective view of a developer roller (416) of a developer unit (FIG. 4, 412) with a first portion (FIG. 1, 104-1) of a multi-portion consumable component (FIG. 1, 102) identifier disposed thereon, according to an example of the principles described herein. As described above, the developer roller (416) transfers print compound (FIG. 4, 418) from a reservoir to the OPC drum (FIG. 4, 414). As described above, a first portion (104-1) of a hardware-based identifier is formed on the developer roller (416). In one example, the first portion (104-1) may be embossed, or raised on the surface of the developer roller (416). Accordingly, as the developer roller (416) collects print compound (FIG. 4, 418) from the reservoir, a copy of that first portion (104-1) is transferred to the OPC drum (FIG. 4, 414) and on to the ITB (FIG. 4, 420).

In some examples, the developer roller (416) may be divided into a number of regions. For example, peripheral regions (524-1, 524-2) are areas that are not used to transfer print compound (FIG. 4, 418) to the OPC drum (FIG. 4, 414). In contrast, an imaging region (522) of the developer roller (416) refers to an area through which images may be formed for transfer to a print medium. In some examples, the hardware-based identifiers may be arranged in peripheral regions (524-1, 524-2), so as to not interfere with the transfer of toner from the reservoir to the OPC drum (FIG. 4, 414).

FIG. 6 is a perspective view of an organic photoconductor (OPC) drum (414) with a portion (104-2) of a multi-portion consumable component (FIG. 1, 102) identifier disposed thereon, according to an example of the principles described herein.

As described above, the OPC drum (414) is a component that receives charged print compound (FIG. 4, 418) and transfers it to an ITB (FIG. 4, 420), which ITB (FIG. 4, 420) ultimately deposits the print compound (FIG. 4, 418) on a print media. Accordingly, the OPC drum (414) may be formed of an electrically-conductive material such as a metal or a metalloid. Specifically, the OPC drum (414) may be formed of aluminum, titanium, tin, copper, palladium, and indium, by way of non-limiting example.

The OPC drum (414) may be formed of various layers. For example, an undercoat layer may be formed over the electrically-conductive core. The undercoat layer may include a smoothing layer that includes materials to enable a relatively smooth and even profile. Example materials for the undercoat layer include resins, such as polyamides, polyesters, melamines, and the like. Other example materials include metal oxides, such as aluminum oxide, titanium oxide, tin oxide, copper oxide, palladium oxide, and indium oxide, by way of non-limiting examples. In some examples, a portion (FIG. 1, 104) of a hardware-based identifier has been arranged on the electrically-conductive substrate (e.g., etched, deposited, etc.) and the undercoat layer may be deposited to ensure a relatively smooth and even profile. That is, the undercoat layer may be used to avoid bulges in the photoconductive surface directly above the portion (FIG. 1, 104) of the hardware-based identifier.

In some examples, a photoconductive layer is disposed on top of the undercoat layer. The photoconductive layer may include multiple layers of different materials. For example, the photoconductive layer may include a charge generation layer (CGL) and a charge transport layer (CTL). For CGLs, example materials may include polyvinyl acetates and polyketals, by way of example. Charge generation materials may include phtalocyanines and azos, by way of example. For CTLs, example materials may include polycarbonates, polyesters, and polystyrenes.

In another example, a single photoconductive layer may be deposited on the undercoat layer. In this example, the single photosensitive layer includes an electron transport material of some type. Electron transport materials may include azoquinons.

As enabled by the undercoat layer, the photoconductive layer may also have a uniform profile. That is, the undercoat layer may be deposited over the portion (FIG. 1, 104) of the hardware-based identifier in such a manner as to ensure a relatively smooth and even profile. The photoconductive layer when deposited thereon, may also have a relatively smooth and even profile.

As described above, a second portion (104-2) of a hardware-based identifier is formed on the OPC drum (414), and in some cases may be human-indiscernible. In one example, the second portion (104-2) may be etched in the cylindrical electrically-conductive substrate. In another case, the second portion (104-2) may be deposited or placed on the substrate, such as by using a printing process like lithography or photolithography, by way of example. In either case, the second portion (104-2) of the hardware-based identifier may be such that a characteristic, such as the conductivity, of the substrate and/or photoconductive layer may differ as compared to cases in which no portion (104) of the hardware-based identifier is present. For example, the photoconductive layer may be slightly thicker above an etched second portion (104-2) of the hardware-based identifier. Thus, conductivity in a region above the second portion (104-2) of the hardware-based identifier may be different (e.g., less) than in surrounding regions.

In an example where the second portion (104-2) of the hardware-based identifier is deposited on the substrate, the photoconductive layer may be thinner in a region above the second portion (104-2) of the hardware-based identifier than in surrounding regions. Thus, the conductivity in the region above the second portion (104-2) of the hardware-based identifier may be different (e.g., greater) than in the surrounding regions. Furthermore, the second portion (104-2) of the hardware-based identifier may alter the conductive characteristics of the conductive substrate upon which it is arranged. In these example cases, and others, the second portion (104-2) of the hardware-based identifier may enable formation of a copy of the second portion (104-2) associated with the OPC drum (414).

In some examples, the OPC drum (414) may be divided into a number of regions. For example, peripheral regions (628-1, 628-2) are areas that are not used to transfer markings to a print medium. In contrast, an imaging region (626) of the OPC drum (414) refers to an area on which print images may be formed for transfer to a print medium. In some examples, the portions (104) may be arranged in peripheral regions (628-1, 628-2), such that any resulting copies do not interfere with the marking of a print medium.

As described above, in some examples, a copy of the first portion (104-1) that corresponds to the developer roller (FIG. 4, 416) may also be deposited on the OPC drum (414), be it in sequential fashion as depicted in FIG. 6, or overlapping the second portion (104-2) associated with the OPC drum (414) over the first portion (104-2) associated with the developer roller (FIG. 4, 416).

In the example where a sensor (FIG. 1, 106) is disposed near the OPC drum (414), the portions (104) of the hardware-based identifier in a peripheral region (628) may be sensed by a sensor (FIG. 1, 106) in proximity to the peripheral region (628).

In another case, rather than sensing the portions (104) on the OPC drum (414), the portions (104), or copies thereof, may be sensed on the ITB (FIG. 4, 420), such as within a region of the ITB (FIG. 4, 420) corresponding to peripheral regions (628) of the OPC drum (414).

Figure 7:
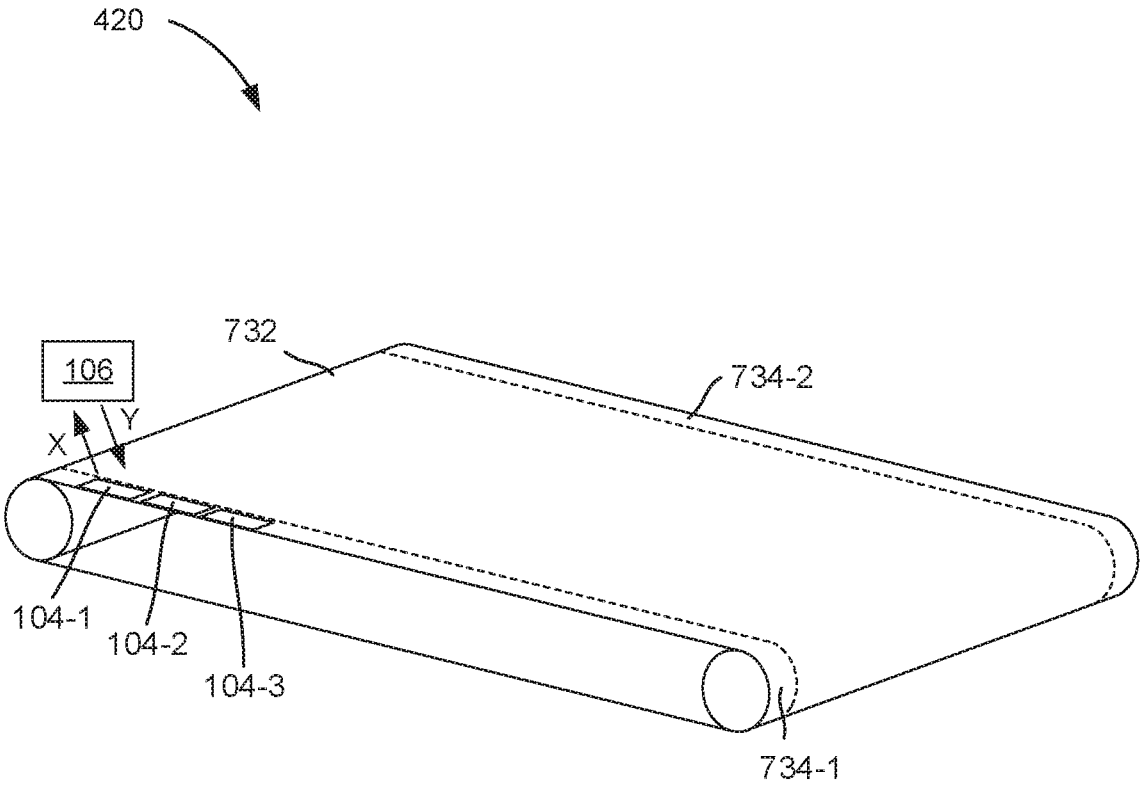
FIG. 7 is a perspective view of an intermediate transfer belt (ITB) with a portion of a multi-portion consumable component identifier disposed thereon, according to an example of the principles described herein.

FIG. 7 is a perspective view of an intermediate transfer belt (ITB) (420) with a portion (104) of a multi-portion consumable component (FIG. 1, 102) identifier disposed thereon, according to an example of the principles described herein. As described above, in some examples the portions (104) of the hardware-based identifier may be arranged on the different components such that the associated copies, be they latent or visible, do not contact print media. Accordingly, the portion (104-3) of the hardware-based identifier that is formed on the ITB (420) may be arranged such that the associated copies of the other portions (104-1, 104-2) are on the peripheral regions (734-1, 734-2) which correspond to peripheral regions (FIG. 6, 628-1, 628-2) of the OPC drum (FIG. 4, 414). That is, the first and second portions (104-1, 104-2), be they latent or visual, from the peripheral region (FIG. 6, 628-1) of the OPC drum (FIG. 4, 414) may transfer into peripheral region (734-1, 734-2) of the ITB (420). In this example, print media may come into contact with the imaging region (732) and print images may be transferred to the ITB (420) without necessarily transferring the hardware-based identifier to the print media.

As described above, various copies of the different portions (104) may be transferred to, and read from the ITB (420). For example, a first portion (104-1) from the developer roller (FIG. 4, 416) and a second portion (104-2) of the identifier associated with the OPC drum (FIG. 4, 414) may transfer to the peripheral region (734-1) of the ITB (420).

As depicted in FIG. 7, in some examples, the different portions (104) may be sequentially formed. That is, the controller (FIG. 1, 108) may control the print components such that the different portions (104) are juxtaposed next to one another.

In another example, the controller (FIG. 1, 108) may control the print components such that the different portions (104) overlap one another. For example, the developer roller (FIG. 4, 416) may include a first portion (104-1) of a QR code. The developer roller (FIG. 4, 416) may be positioned, sized, and rotated such that a copy of the first portion (104-1) of the QR code is deposited over a region of the OPC drum (FIG. 4, 414) that contains a second portion (104-2) of the QR code. Still further, copies that correspond to these first and second portions (104) of the hardware-based identifier may be deposited over a region of the ITB (420) that includes third portion (104-3) of the QR code. In this example, the combination of the three portions (104) results in a QR code that can be read and analyzed by the controller (FIG. 1, 108) as described above.

In any example, the latent or visual image of the hardware-based identifier may move into proximity of a sensor (106), which may be able to detect the image. FIG. 7 depicts a particular example where the sensor (106) is a photo transceiver and transmits EMR.

Figure 8:
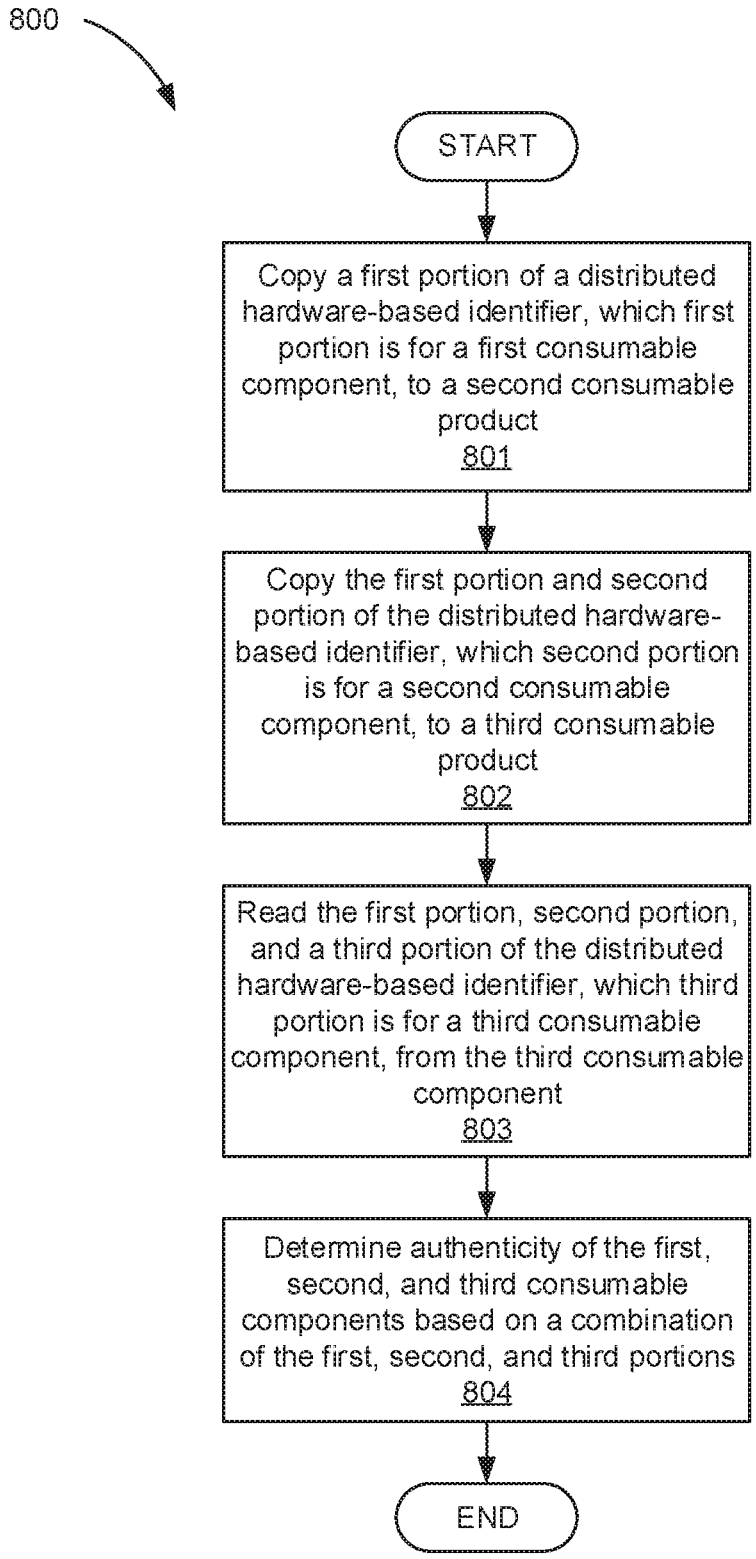
FIG. 8 is a flow chart of a method for reading a multi-portion consumable component identifier, according to another example of the principles described herein.

FIG. 8 is a flow chart of a method (800) for reading a multi-portion (FIG. 1, 104) consumable component (FIG. 1, 102) identifier, according to another example of the principles described herein. According to the method (800), a first portion (FIG. 5, 104-1) of a distributed hardware-based identifier is copied (block 801) from a first consumable component (FIG. 1, 102) onto a second consumable component (FIG. 1, 102). For example, as described above, a print device (FIG. 1, 100) may include multiple consumable components (FIG. 1, 102) and it may be desirable to authenticate them as a group, rather than individually as an additional security measure. For example, it may be easier for a nefarious user to counterfeit one consumable component (FIG. 1, 102) than counterfeit three consumable components (FIG. 1, 102). Accordingly, the present method (800) describes a way to authenticate the aggregate of multiple consumable components (FIG. 1, 102) rather than doing so individually. This is accomplished by breaking up an identifier which is to be authenticated across multiple components.

Accordingly, a first portion (FIG. 5, 104-1) is disposed on a first consumable component (FIG. 1, 102), such as a developer roller (FIG. 4, 416). That first portion (FIG. 5, 104-1) is copied (block 801) to a second consumable component (FIG. 1, 102). For example, the first portion (FIG. 5, 104-1) may be disposed as a raised or embossed portion of the developer roller (FIG. 4, 416). As the developer roller (FIG. 4, 416) passes through the print compound (FIG. 4, 418) in the reservoir, it collects the print compound (FIG. 4, 418) on the embossed first portion (FIG. 5, 104-1). As the developer roller (FIG. 4, 416) rotates and contacts the OPC drum (FIG. 4, 414), a nip is formed through which the print compound (FIG. 4, 418) on the embossed first portion (FIG. 5, 104-1) is deposited on the OPC drum (FIG. 4, 414) in the form of the embossed first portion (FIG. 5, 104-1). In another example, the copy may be a negative image. That is, a raised area on the developer roller (FIG. 4, 416) may create an area starved of print compound (FIG. 4, 418), which would be exposed as a negative image on the OPC drum (FIG. 4, 414) when a block of print compound (FIG. 4, 418) around it is imaged. This first portion (FIG. 5, 104-1), along with a copy of the second portion (FIG. 6, 104-2) disposed on the OPC drum (FIG. 4, 414) is then copied (block 802) to a third consumable product (FIG. 1, 102).

As described above, the different portions (FIG. 1, 104) of the hardware identifier may be of differing forms. For example, the first portion (FIG. 5, 104-1) from the developer roller (FIG. 4, 416) may be a visual image whereas the second portion (FIG. 6, 104-2) on the OPC drum (FIG. 4, 414) may be a latent image. The sensor(s) (FIG. 1, 106) that read the combined hardware identifier are selected to read the corresponding portions (FIG. 1, 104) based on the form of the images.

As described above, the OPC drum (FIG. 4, 414) contacts the ITB (FIG. 4, 420) to transfer visual images in the imaging region. Copies of the first and second portions (FIG. 5, 104-1, FIG. 6, 104-2), which are now disposed on a peripheral region (FIG. 6, 628-1) of the OPC drum (FIG. 4, 414) are also transferred to the ITB (FIG. 4, 420) via the nip between the ITB (FIG. 4, 420) and the OPC drum (FIG. 4, 414).

As described above, the sequential transfer of the different portions (FIG. 1, 104) may be sequential or overlapping. That is, each of the first portion (FIG. 5, 104-1), second portion (FIG. 5, 104-2), and third portion (FIG. 7, 104-3) may be components of a single identifier, or may each be their own image or sequence of numbers to which subsequently portions are appended.

The first, second, and third portions (FIG. 5, 104-1, FIG. 6, 104-2, FIG. 7, 104-3) are then read (block 803). As described above, this may be accomplished by multiple sensor(s) (FIG. 1, 106) disposed throughout the print device (FIG. 1, 100) or may be by a single sensor (FIG. 1, 106). For example, a single sensor (FIG. 1, 106) as depicted in FIG. 4 may be positioned adjacent the ITB (FIG. 4, 420) and may generate signals based on a sensing of visual or latent portions (FIG. 1, 104) of the hardware identifier. The controller (FIG. 1, 108) then determines (block 804) an authenticity of the different consumable components (FIG. 1, 102) based on the verification of the associated portions (FIG. 1, 104). That is, the print device (FIG. 1, 100) may store, or have access to a database of known identifiers. If the combination of portions (FIG. 1, 104) matches the known identifiers, then the corresponding components (FIG. 1, 102) may be identified as authentic, that is having a predetermined quality or originating from a known and authorized source. If the combination of portions does not match the known identifiers, then at least one of the corresponding components is not authentic. In this example, the controller may provide a notification to this effect, and in some cases may identify the unauthorized component.

Thus the present specification describes a print device and method that facilitate the authentication of not only individual consumable components, but groups of consumable components by distributing an identifier across the multiple components. As each portion by itself is incomplete, each portion must be combined with other components to result in any sort of authentication determination. Thus enhanced system security is provided.

In summary, using such a multi-portion hardware-based consumable component identifier 1) provides control over which consumable components may be used in a print device, 2) prevents against potential quality defects and component damage based on improper consumable component use, and 3) enhances security of the system by distributing the hardware-based identifier over multiple consumable components.

What is claimed is:

1. A print device comprising:

a plurality of consumable components, each respective consumable component of the plurality of consumable components comprising a respective portion of a physical hardware-based identifier physically formed on a surface of the respective consumable component;

at least one sensor to read multiple portions of the physical hardware-based identifier; and a controller to:

combine the multiple portions of the physical hardware-based identifier; and verify the physical hardware-based identifier to determine an authenticity of the plurality of consumable components.

2. The print device of claim 1, wherein the multiple portions of the physical hardware-based identifier are human-indiscernible.

3. The print device of claim 1, wherein the print device is to juxtapose the multiple portions of the physical hardware-based identifier on one consumable component of the plurality of consumable components.

4. The print device of claim 3, wherein the at least one sensor comprises a single sensor to read the juxtaposed multiple portions from the one consumable component.

5. The print device of claim 1, wherein different portions of the physical hardware-based identifier are in different formats on different consumable components of the plurality of consumable components.

6. The print device of claim 1, wherein the plurality of consumable components comprise:

a developer unit comprising a first unique portion of the physical hardware-based identifier;

an organic photoconductor (OPC) drum comprising a second unique portion of the physical hardware-based identifier; and an intermediate transfer belt (ITB) comprising a third unique portion of the physical hardware-based identifier, wherein the ITB is to receive the first and second unique portions of the physical hardware-based identifier from the developer unit and the OPC drum, respectively, wherein the at least one sensor comprises a single sensor adjacent to the ITB to read the first, second, and third unique portions of the physical hardware-based identifier from a surface of the ITB, and wherein the controller is to adjust an operation of the print device in response to a determined authenticity of the plurality of consumable components.

7. The print device of claim 6, wherein the first unique portion is transferred from a developer roller of the developer unit to the OPC drum, and the second unique portion and the first unique portion are transferred from the OPC drum to the ITB.

8. The print device of claim 1, wherein the multiple portions of the physical hardware-based identifier are not encoded in a computer-readable medium.

9. The print device of claim 1, wherein the print device is to copy a first portion of the physical hardware-based identifier from a first consumable component of the plurality of consumable components to a second consumable component of the plurality of consumable components, and wherein the at least one sensor is to read the first portion of the physical hardware-based identifier and a second portion of the physical hardware-based identifier from the second consumable component, wherein the second portion of the physical hardware-based identifier is physically formed on a surface of the second consumable component.

10. The print device of claim 1, wherein the multiple portions of the physical hardware-based identifier are provided on different consumable components of the plurality of consumable components.

11. A method comprising:

reading a first portion of a distributed hardware-based identifier for a first consumable component;

reading a second portion of the distributed hardware-based identifier for a second consumable component, wherein the first portion and the second portion are read from the second consumable component; and determining, by a controller, an authenticity of a combination of the first consumable component and the second consumable component based on a combination of the first portion and the second portion.

12. The method of claim 11, wherein the first portion and the second portion are physically formed on the first consumable component and the second consumable component, respectively.

13. The method of claim 11, further comprising copying the first portion from the first consumable component to the second consumable component.

14. The method of claim 13, further comprising:

copying the first portion and a third portion of the distributed hardware-based identifier for a third consumable component to the second consumable component;

reading the first portion, the second portion, and the third portion from the second consumable component; and determining an authenticity of a combination of the first consumable component, the second consumable component, and the third consumable component based on a combination of the first portion, the second portion, and the third portion.

15. The method of claim 14, further comprising copying the first and third portions to locations of the second consumable component that do not contact print media.

16. The method of claim 11, wherein at least one of reading the first portion or reading the second portion comprises:

transmitting, from a sensor, electromagnetic radiation towards the second consumable component; and receiving, at the sensor, reflected electromagnetic radiation.

17. The method of claim 11, wherein the first and second portions of the distributed hardware-based identifier are not encoded in a computer-readable medium.

18. The method of claim 11, wherein the distributed hardware-based identifier is a physical hardware-based identifier, and the first portion and the second portion of the physical hardware-based identifier are physically formed on respective surfaces of the first consumable component and the second consumable component.

19. A consumable component comprising:

a surface; and a portion of a human-indiscernible hardware-based identifier arranged on the surface, wherein the portion of the human-indiscernible hardware-based identifier is to be combined with other portions of the human-indiscernible hardware-based identifier on other consumable components for verification of a group of consumable components, wherein the consumable component is selected from the group consisting of:

a developer unit comprising the portion as an embossed image on a developer roller of the developer unit;

an organic photoconductor (OPC) drum comprising the portion being etched into a surface of the OPC drum; and an intermediate transfer belt (ITB) comprising the portion as a latent image on a surface of the ITB.

20. The consumable component of claim 19, wherein the other consumable components are different from the consumable component and are selected from the group consisting of the developer unit, the OPC drum, and the ITB.

* * * * *